US008774657B2

(12) United States Patent
Uehara

(10) Patent No.: US 8,774,657 B2
(45) Date of Patent: Jul. 8, 2014

(54) IMAGE FORMING APPARATUS WITH POWER SUPPLY CONTROL

(75) Inventor: Masahiro Uehara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 889 days.

(21) Appl. No.: 12/915,433

(22) Filed: Oct. 29, 2010

(65) Prior Publication Data

US 2011/0110677 A1 May 12, 2011

(30) Foreign Application Priority Data

Nov. 6, 2009 (JP) ..... 2009-255098

(51) Int. Cl.
*G03G 15/02* (2006.01)

(52) U.S. Cl.
USPC ..... 399/50; 399/66; 399/88

(58) Field of Classification Search
USPC ..... 399/50, 66, 88
See application file for complete search history.

(56) References Cited

FOREIGN PATENT DOCUMENTS

JP 6-3932 A 1/1994
JP 2009-180882 A 8/2009

OTHER PUBLICATIONS

English machine translation of JP 2009-180882 A.*

* cited by examiner

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

An image forming apparatus includes a latent image forming unit that forms a latent image on an image bearing member, a developing unit that develops the latent image to obtain a developer image, and a transfer unit that transfers the developer image to a recording medium. A first supply unit supplies a voltage to a charging unit and the transfer unit, with the first supply unit including a transformer, and a second supply unit supplies a voltage to the transfer unit, with the second supply unit including a transformer and supplying a voltage supplied opposite in polarity to the voltage supplied from the first supply unit. In addition, a detection unit detects current flowing through the transfer unit, and a control unit is configured to control power supply. When a power is supplied from the first supply unit to the charging unit, the control unit sets a discharge start voltage in which discharging starts between the image bearing member and the charging unit is based on a current detected by the detection unit, and when power is supplied from the second supply unit to the transfer unit, the control unit sets one or more adjusted voltages by calculating one or more voltages to be supplied from the transfer unit so that a current detected by the detection unit is to be a predetermined value. The first supply unit supplies a voltage to the charging unit based on the discharge start voltage and the adjusted voltage set by the control unit.

5 Claims, 10 Drawing Sheets

IMAGE FORMING APPARATUS WITH POWER SUPPLY CONTROL

BACKGROUND OF THE INVENTION

1. Field of the Invention

The present invention relates to an electrophotographic image forming apparatus including an electrophotographic copy machine, an electrophotographic printer (for example, LED printer or laser beam printer), and an electrophotographic facsimile apparatus.

2. Description of the Related Art

FIG. 10A illustrates a schematic structure illustrating a charge bias circuit of a conventional image forming apparatus. A charge DC bias circuit part (hereinafter, referred to as charge bias application circuit unit) 1201 includes a voltage set circuit part (unit) 1202, a transformer drive circuit part 1203, a high-voltage transformer part (unit) 1204, and a feedback circuit part (unit) 1205. The voltage set circuit part (unit) 1202 may change a voltage value set based on an input PWM signal. The transformer drive circuit part (unit) 1203 drives the high-voltage transformer part (unit) 1204. The feedback circuit part (unit) 1205 uses a resistor R1201 to detect a voltage value applied to a charge roller 1206 (load) which is a charging member, and transfers the detected voltage value as an analog value to the voltage set circuit part (unit) 1202. The voltage set circuit part (unit) 1202 controls to apply a constant voltage (voltage indicated by PWM signal) to the charge roller 1206 which is the charging member based on a value of the PWM signal and a feedback value. When an applied voltage is controlled using such a structure, a constant voltage value may be applied to the charge roller 1206 (see, for example, Japanese Patent Application Laid-Open No. H06-003932).

However, a voltage for starting discharge between the charging member (charge roller) and an image bearing member changes depending on a circumstance temperature and humidity in the image forming apparatus or a film thickness of a photosensitive drum (hereinafter, simply referred to as drum film thickness). Therefore, as illustrated in FIG. 10B, even when control is performed to apply a predetermined voltage (controlled PWM value), a variation in potential on the photosensitive drum is caused by temperature-humidity (such as low temperature and low humidity (L/L) or high temperature and high humidity (H/H)). The variation causes a change in image density. In order to correct the change in image density, it is necessary to provide a density detection sensor for detecting an image density and a temperature-humidity sensor for detecting a temperature and a humidity in the image forming apparatus, and control the image density based on a result obtained by detection by the density detection sensor. When the density detection sensor and the temperature-humidity sensor are provided in the image forming apparatus, an apparatus cost may increase. When the density detection sensor and the temperature-humidity sensor are not provided, it is difficult to adequately correct the change in image density.

SUMMARY OF THE INVENTION

The present invention has been made in view of the problem described above.

A purpose of the invention to provide a feature that a variation in potential of an image bearing member may be reduced in an apparatus having a low-cost structure.

Another purpose of the present invention is to provide an image forming apparatus including a charging unit that charges an image bearing member on which a latent image is formed, a latent image forming unit that forms the latent image on the image bearing member charged by the charging unit, a transfer unit that develops the latent image formed on the image bearing member to obtain a developer image and transferring the developer image to a recording medium; a first application unit that applies a voltage to the charging unit and the transfer unit; a second application unit for applying, to the transfer unit, a voltage opposite in polarity to the voltage applied from the first application unit; a detection unit that detects a current flowing through the transfer unit; and a control unit that determines whether or not discharge starts between the charging unit and the image bearing member based on the current detected by the detection unit when the voltage is applied from the first application unit to the charging unit.

A further purpose of the present invention will become apparent from the following descriptions of exemplary embodiments with reference to the attached drawings.

DETAILED DESCRIPTION OF THE EMBODIMENTS

Figure 1:
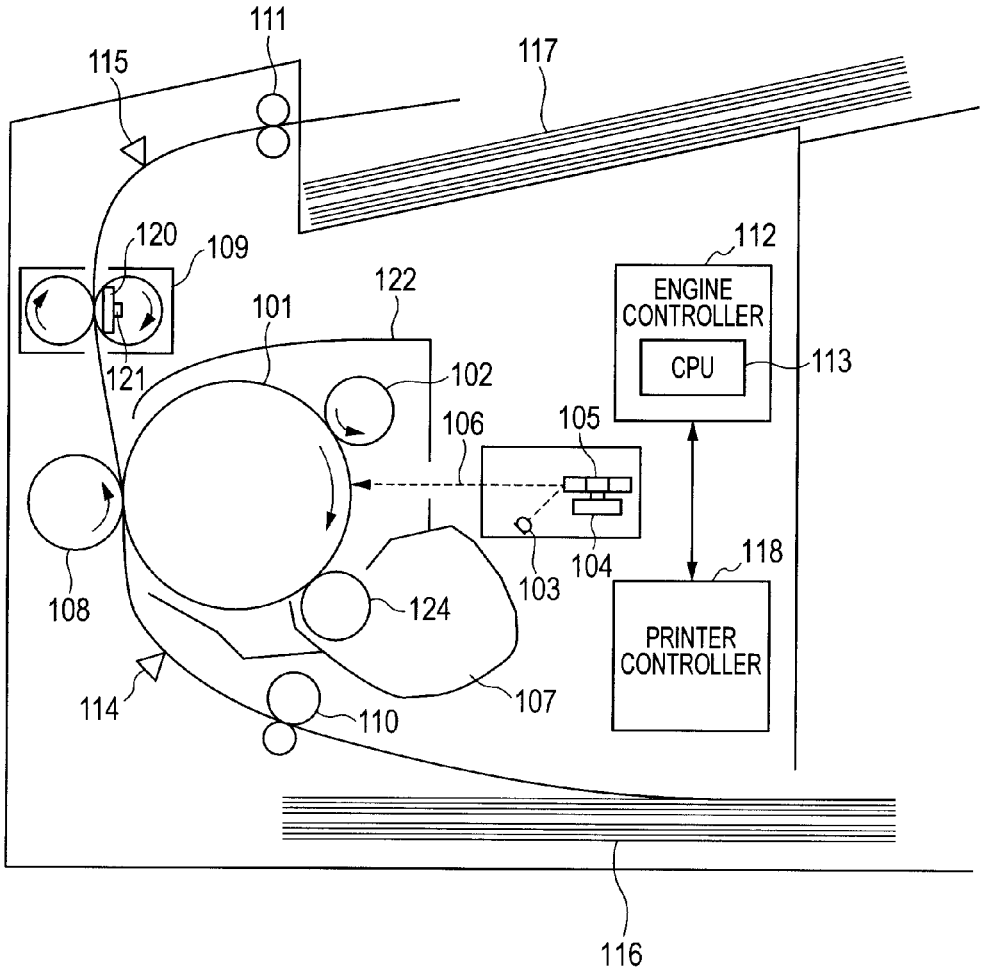
FIG. 1 is a cross sectional diagram illustrating a main body of an image forming apparatus according to a first embodiment of the present invention.

Hereinafter, structures and operations in the present invention are described. Note that, embodiments described below are merely an example, and are not intended to limit the technical scope of the present invention thereto.

Hereinafter, the embodiments of the present invention are described with reference to the attached drawings.

First, the first embodiment is described. An image forming apparatus according to the first embodiment has a structure in which high voltages are applied as a charge bias and a transfer cleaning bias from a single transformer for high-voltage generation (hereinafter, referred to as high-voltage transformer). The charge bias is a high voltage applied to a charge roller in order to uniformly charge a surface of a photosensitive drum serving as an image bearing member. The transfer cleaning bias is a negative high voltage for transferring, to an intermediate transfer belt, a developer deposited on a transfer roller for transferring an image (hereinafter, referred to as negative transfer bias). A constant voltage source capable of applying a desired high voltage as the charge bias is provided. A current value flowing through the transfer roller in a case where a gradually increased charge bias is applied is detected by a current detection circuit provided for transfer bias (hereinafter, referred to as positive transfer) output. An output voltage of the constant voltage source for the charge bias in a case where the detected current value reaches a desired value is detected. A potential on the photosensitive drum (hereinafter, referred to as drum potential) serving as the image bearing member is controlled to a predetermined value based on the detected voltage.

[Structure of Image Forming Apparatus]

First, a laser beam printer which is an example of the image forming apparatus according to this embodiment is described with reference to FIG. 1. A laser beam 106 is emitted from a semiconductor laser 103 serving as a light source. The laser beam 106 is used to scan a photosensitive drum 101 serving as the image bearing member by a rotating polygonal mirror 105 rotated by a scanner motor 104. An interchangeable cartridge 122 includes a charge roller 102 for uniformly charging the photosensitive drum 101 and a developing device 107 for developing, with toner serving as a developer, an electrostatic latent image formed on the photosensitive drum 101 by exposure with the laser beam 106. A transfer roller 108 is provided to transfer, to a sheet serving as a recording medium, a toner image which is a developer image obtained by development by a developing roller 124 of the developing device 107. A fixing device 109 fuses the toner transferred to the sheet by heat to fix the toner image to the sheet. The sheet is set in a manual feed tray 116. The sheet is fed from the manual feed tray 116 to a conveyance path by one turn of sheet feed rollers 110. A top sensor 114 is provided to synchronize the image writing (recording/printing) on the photosensitive drum 101 for the fed sheet with the transfer of the recording sheet and measure a length of the fed sheet in a conveyance direction. Delivery rollers 111 are provided to deliver, to a delivery tray 117, the sheet to which the toner image is fixed. A delivery sensor 115 detects the presence or absence of the sheet to which the toner image is fixed. An engine controller 112 (also referred to as engine control unit) includes a CPU 113 and controls a series of image formation operations described above. That is, the engine controller 112 controls respective units of an engine of the laser beam printer and controls a printing operation in response to an instruction of a printer controller 118. The engine controller 112 sends state information indicating an internal state of the laser beam printer to the printer controller 118. The state information is information indicating a sheet conveyance state, the presence or absence of the sheet, and an abnormal state. The printer controller 118 serves to decode image code data sent from an external device, for example, a host computer (not shown) into bit data required for printing of the laser beam printer, and serves to read the internal information of the laser beam printer and display the internal information thereof.

Figure 2A:
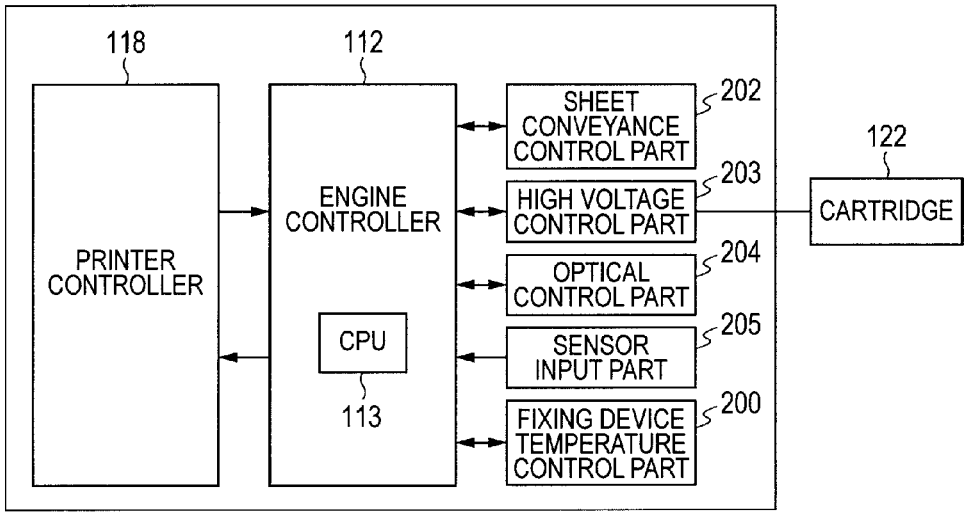
FIG. 2A is a block diagram illustrating the main body of the image forming apparatus according to the first embodiment.

FIG. 2A is a block diagram illustrating a structure of a control unit of the entire laser beam printer including the engine controller 112 and the printer controller 118. A structure of a printer main body 201 is as follows. A high-voltage control part 203 controls high voltage outputs during respective processes including charging, development, and transfer in response to an instruction of the engine controller 112. An optical system control part 204 controls the start and stop of the scanner motor 104 for rotating the rotating polygonal mirror 105 and the turn-on operation of the semiconductor laser 103 in response to the instruction of the engine controller 112. A fixing device temperature control part 200 controls the start and stop of supply of power to a fixing heater 120 based on temperature information from a thermistor 121 for detecting a fixing temperature in response to the instruction of the engine controller 112. A sensor input part 205 sends, to the engine controller 112, signals from sensors including the top sensor 114 and the delivery sensor 115, for detecting the presence or absence state of the sheet in the laser beam printer. A sheet conveyance control part 202 performs the start and stop of motors and rollers to convey the sheet in response to the instruction of the engine controller 112, and controls the start and stop of the sheet feed rollers 110, rollers of the fixing device 109, and the delivery rollers 111.

Figure 2B:
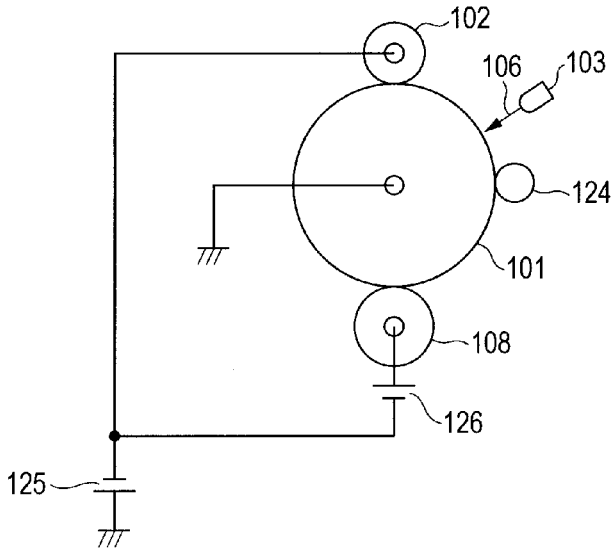
FIG. 2B is a schematic diagram illustrating a cartridge of the image forming apparatus according to the first embodiment.

FIG. 2B illustrates a schematic structure of the cartridge 122 illustrated in FIG. 1 in a case where voltages are applied. A negative-polarity bias is applied from an application circuit 125 to the charge roller 102 and the transfer roller 108. A positive-polarity high voltage is applied from an application circuit 126 to the transfer roller 108.

[High-Voltage Generation Circuit of Image Forming Apparatus]

Figure 3:
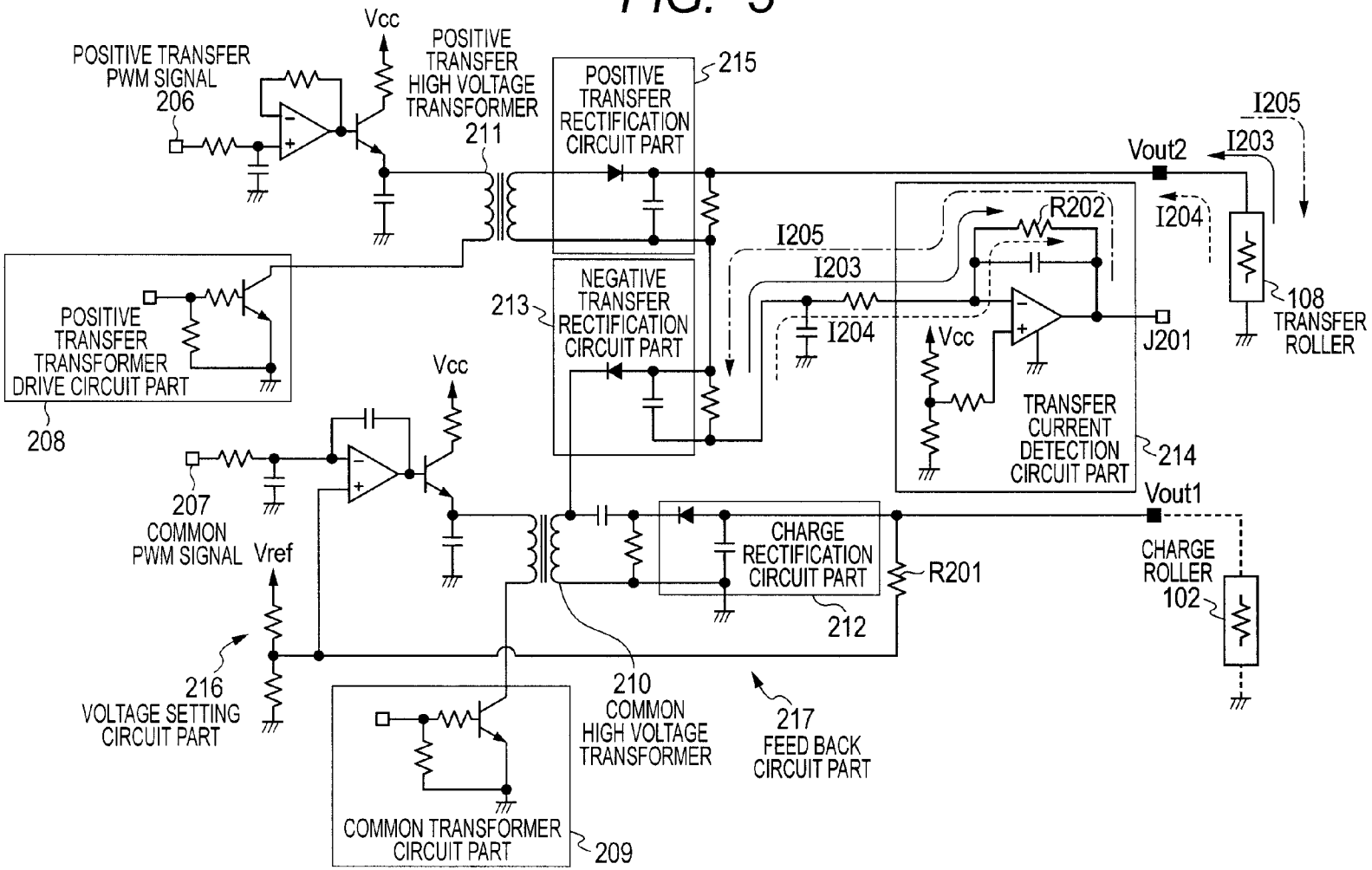
FIG. 3 is a circuit diagram illustrating a bias generation circuit in the first embodiment.

FIG. 3 is a schematic structural diagram illustrating a charge bias generation circuit, a negative-transfer bias generation circuit, and a positive-transfer bias generation circuit in this embodiment. A voltage setting circuit part 216 may change a charge bias value and a negative transfer bias value based on a common PWM signal 207. A common transformer drive circuit part 209 drives a common high-voltage transformer 210 (first application unit). The common high-voltage transformer 210 is connected to a charge rectification circuit part 212 and a negative-transfer rectification circuit part 213. A charge bias of an output voltage value Vout1 and a negative transfer bias of an output voltage value Vout2 are supplied to the charge roller 102 and the transfer roller 108, respectively. A feedback circuit part 217 monitors the output voltage value Vout1 through a resistor R201 and performs feedback to obtain the output voltage value Vout1 corresponding to the setting of the common PWM signal 207. In this case, the output voltage value Vout1 corresponding to the setting of the common PWM signal 207 is output as the output voltage value Vout2 of the negative transfer bias from the common high-voltage transformer 210. A transfer current detection circuit part 214 (detection unit) detects a current I203 flowing through the transfer roller 108 and transmits the detected current value as an analog value from a terminal J201 to the CPU 113 of the engine controller 112. The current I203 flows before the start of discharge between the photosensitive drum 101 and the charge roller 102. A current I204 flows after the start of discharge between the photosensitive drum 101 and the charge roller 102. A positive-transfer transformer drive circuit part 208 drives a positive-transfer high-voltage transformer 211 (second application unit) based on a positive transfer PWM signal 206. The positive-transfer high-voltage transformer 211 is connected to a positive-transfer rectification circuit part 215.

[Detection of Discharge Start Voltage Value]

Before the start of discharge between the photosensitive drum 101 and the charge roller 102, the photosensitive drum 101 and the charge roller 102 are insulated from each other. Therefore, before the start of discharge, a load of the common high-voltage transformer 210 is only the resistor R201.

Therefore, a step-up voltage corresponding to a value of the resistor R201 is output from the common high-voltage transformer 210 to the charge rectification circuit part 212. At this time, the step-up voltage corresponding to the value of the resistor R201 is also output from the common high-voltage transformer 210 to the negative-transfer rectification circuit part 213, and hence the current I203 flows through a detection resistor R202.

Figure 4A:
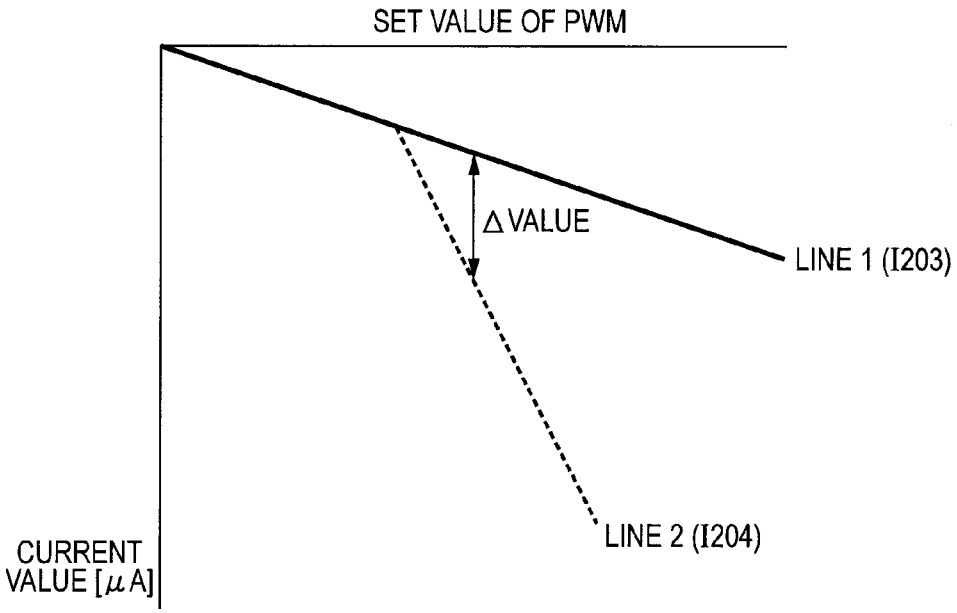
FIG. 4A illustrates a V-I characteristic in a case where a charge bias is applied in the first embodiment.
Figure 4B:
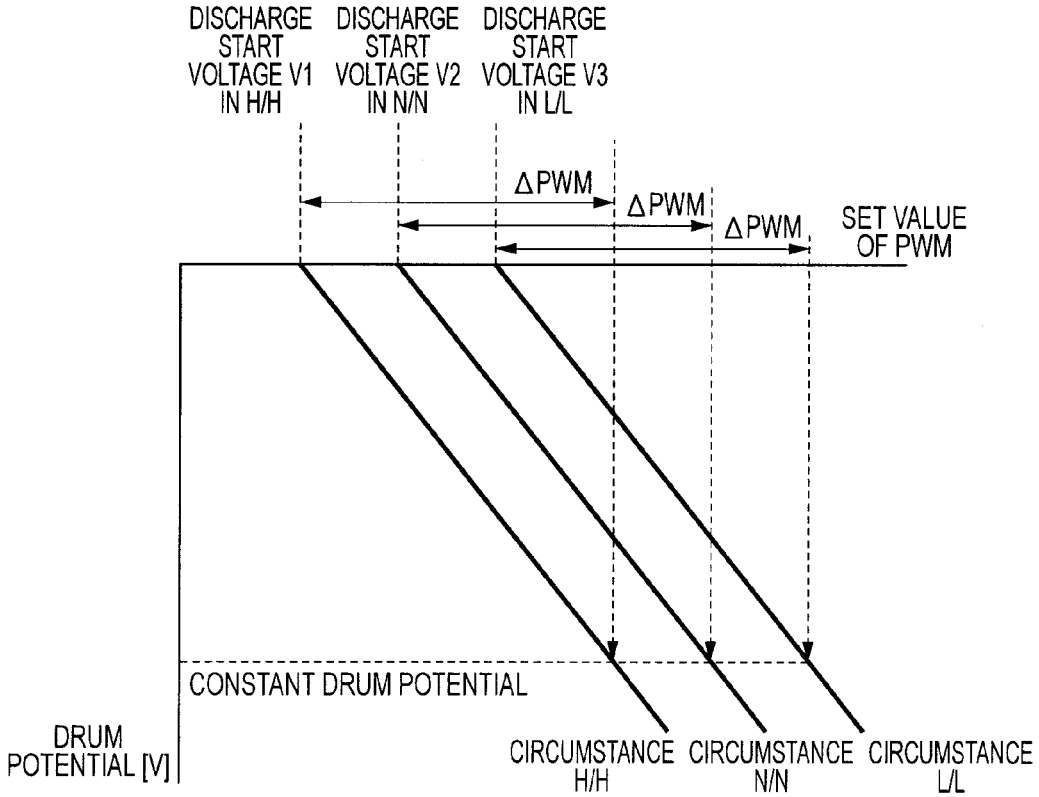
FIG. 4B illustrates correction of a drum potential after a discharge start voltage is detected.

When the discharge starts between the photosensitive drum 101 and the charge roller 102, the load of the common high-voltage transformer 210 becomes a value obtained in a case where the resistor R201 and the charge roller 102 are connected in parallel. The load of the common high-voltage transformer 210 has a relationship "[R201]>[combined resistance value in the case where resistor R201 and charge roller 102 are connected in parallel]", and hence the voltage output from the common high-voltage transformer 210 to the charge rectification circuit part 212 increases. With the increase in voltage, the voltage output from the common high-voltage transformer 210 to the negative-transfer rectification circuit part 213 becomes larger, and hence the current I204 (I204>I203) flows into the detection resistor R202. In other words, as indicated by Line1 illustrated in FIG. 4A, before the start of discharge, the set-up voltage corresponding to the load of the resistor R201 is output to the negative-transfer rectification circuit part 213, and hence the current I203 flows into the detection resistor R202. However, when the discharge starts between the photosensitive drum 101 and the charge roller 102, the voltage corresponding to the load of "[combined resistance value in the case where resistor R201 and charge roller 102 are connected in parallel]" is output to the negative-transfer rectification circuit part 213, and hence the current I204 flows into the detection resistor R202. In other words, as indicated by Line2 illustrated in FIG. 4A, a straight line having a branch point at the time of the start of discharge is exhibited. Therefore, a discharge current is calculated as a delta (Δ) value obtained by subtracting Line1 from Line2, and hence a voltage calculated when the Δ value becomes a desired current value is determined as a voltage at which discharge starts (hereinafter, referred to as discharge start voltage). After discharge start voltages for respective circumstances (V1 (circumstance is high temperature and high humidity: H/H), V2 (circumstance is normal temperature and normal humidity: N/N), and V3 (circumstance is low temperature and low humidity: L/L)) are detected, as illustrated in FIG. 4B, a predetermined voltage value (ΔPWM) is added to each of the discharge start voltages. Therefore, the photosensitive drum may be maintained at a constant potential without depending on a change in circumstance.

[Processing for Maintaining Photosensitive Drum at Constant Potential]

Figure 5:
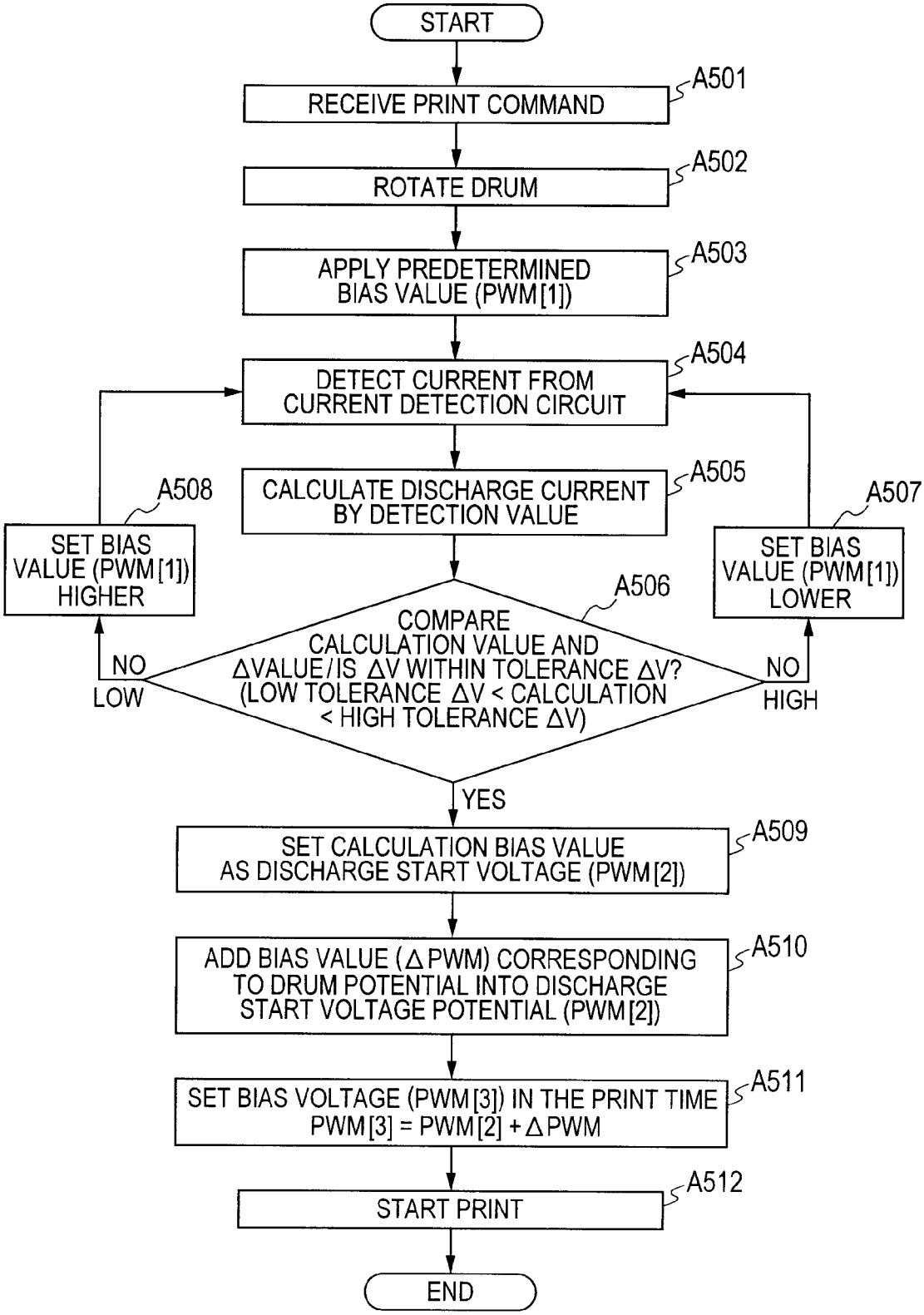
FIG. 5 is a flow chart illustrating processing for controlling the drum potential to a constant value in the first embodiment.

FIG. 5 is a flow chart illustrating control in this embodiment. Upon receiving a print command (Step A501), the engine controller 112 enters a forward rotation operation to start rotating the photosensitive drum 101 and the charge roller 102 (Step A502). After that, the voltage setting circuit part 216 applies a predetermined charge bias to the charge roller 102 based on PWM[1] (Step A503). The transfer current detection circuit part 214 detects the current I203 flowing through the transfer roller 108 and transmits the detected current value as an analog value from the terminal J201 to the CPU 113 (Step A504). The CPU 113 calculates a value corresponding to the Δ value obtained by subtracting Line1 from Line2 illustrated in FIG. 4A, based on the current value detected by the transfer current detection circuit part 214 (hereinafter, the calculated value is referred to as calculation value) (Step A505). The CPU 113 compares the calculation value with a reference Δ value and determines whether or not the calculation value is within a tolerance of the Δ value ((lower tolerance of Δ)<(calculation value)<(higher tolerance of Δ)) (Step A506). When the CPU 113 determines that the calculation value is larger than the higher tolerance of the Δ value, it is determined that the discharge start voltage is a lower voltage, and hence the PWM value for bias setting is set to a low value (Step A507) and processing returns to Step A504. When the CPU 113 determines that the calculation value is smaller than the lower tolerance of the Δ value, it is determined that the discharge start voltage is a higher voltage, and hence the PWM value is set to a higher value (Step A508) and processing returns to Step A504. The CPU 113 performs the control as described above. When the calculation value is within the tolerance of the Δ value, an obtained bias set value is set as the PWM value corresponding to the discharge start voltage, that is, PWM[2] (Step A509). The CPU 113 adds the bias value (ΔPWM) corresponding to the potential on the photosensitive drum to the set discharge start voltage (PWM [2]) (Step A510) and determines a bias value for image formation (PWM[3]=PWM[2]+ΔPWM) (Step A511). After the completion of the setting described above, printing starts (Step A512).

As described above, in this embodiment, the discharge start voltage is accurately detected and the bias value corresponding to the drum potential is added to the detected discharge start voltage. Therefore, even when circumstances vary, the drum potential may be controlled to the constant value. That is, according to this embodiment, a variation in drum potential may be reduced using a low-cost structure without providing a density detection sensor or a temperature-humidity sensor. The structure is described in which the high voltage outputs are supplied from the single high-voltage transformer in order to output the charge bias and the negative transfer bias. However, the present invention is not limited to this structure of this embodiment. For example, as long as the structure capable of similarly performing the current detection is provided, another structure for applying the same-polarity high voltage may be shared.

Next, the second embodiment is described. In the second embodiment, the current value to determine the discharge start voltage at the application of the charge bias is adjusted based on the resistance value of the transfer roller. In this embodiment, the parts corresponding to the same constituent elements as in the first embodiment are denoted by the same reference symbols in the drawings and the description thereof is omitted.

In FIG. 3, when the positive transfer bias reversed in polarity from the charge bias is applied, a current I205 flows through the transfer roller 108. The current I205 flowing through the transfer roller 108 is detected by the transfer current detection circuit part 214 and transmitted as an analog value from the terminal J201 to the CPU 113 of the engine controller 112. Then, the CPU 113 detects the current I205 flowing through the transfer roller 108 and controls the positive transfer bias so that the current value flowing through the transfer roller 108 becomes a desired value.

Figure 6A:
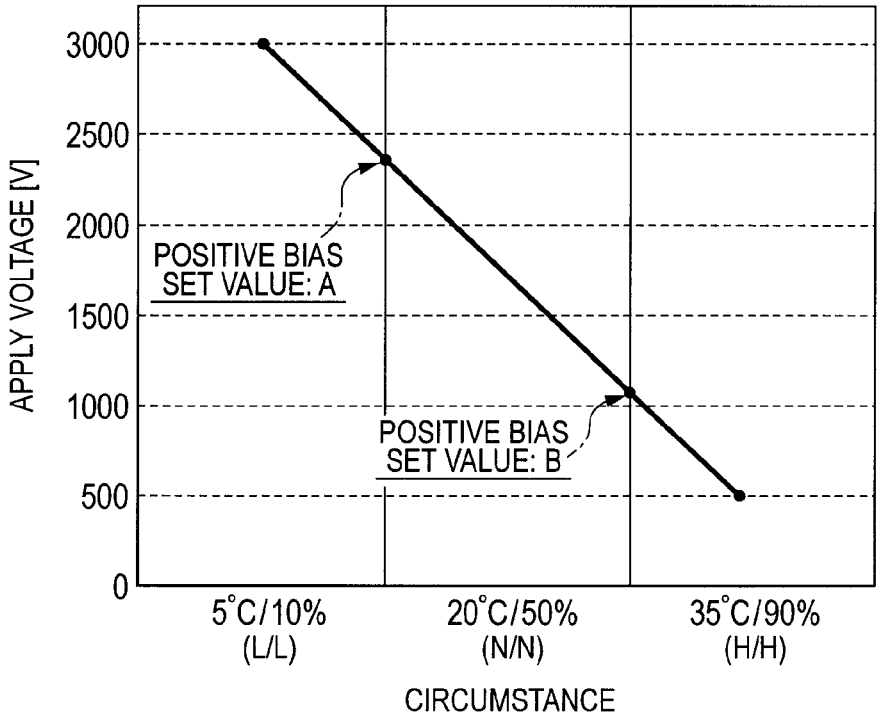
FIG. 6A illustrates a V-I characteristic in a case where a transfer bias is applied in a second embodiment.

FIG. 6A illustrates a V-I characteristic (relationship between voltage and current) corresponding to each circumstance (temperature and humidity) in a case where constant current control is performed so that a current of 2.5 μA flows into the transfer roller 108. An applied voltage in the case where the constant current control is performed on the transfer roller 108 is changed in a range of 500 V to 3,000 V while a circumstance is changed from a high-temperature high-humidity circumstance (for example, 35° C./90% (also referred to as H/H)) to a low-temperature low-humidity circumstance (for example, 5° C./10% (also referred to as L/L)). That is, FIG. 6A illustrates a change in resistance value of the transfer roller 108 due to a change in circumstance. In FIG. 6A, a set value "A" of the positive transfer bias indicates a threshold value for distinguishing between the L/L circumstance and a normal-temperature normal-humidity circumstance (for example, 20° C./50% (also referred to as N/N)). Similarly, in FIG. 6A, a set value "B" of the positive transfer bias indicates a threshold value for distinguishing between the N/N circumstance and the H/H circumstance.

Figure 6B:
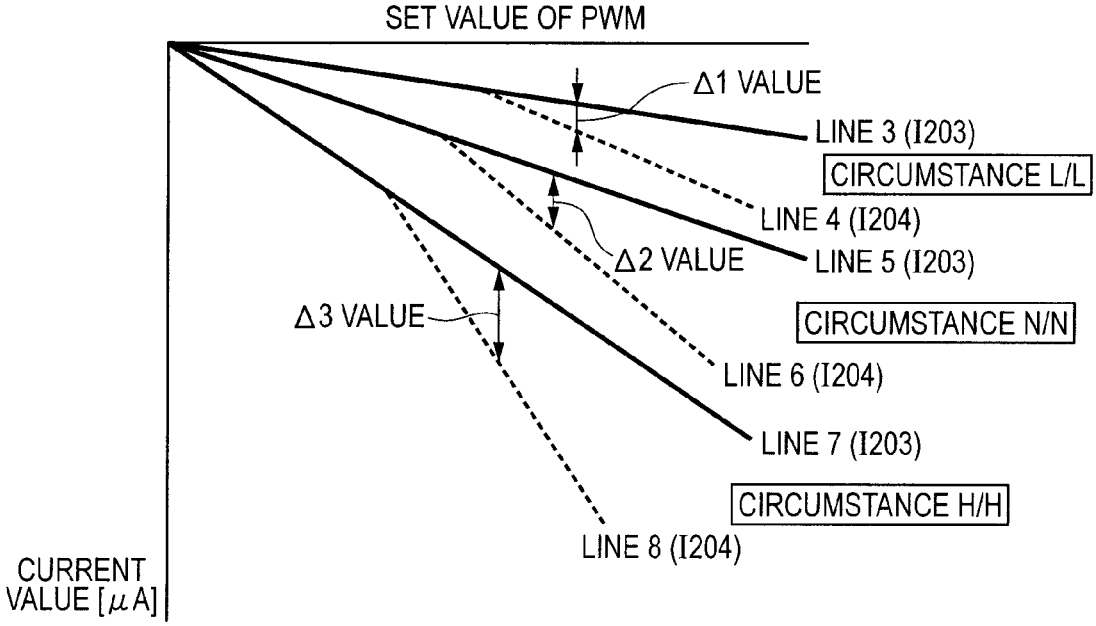
FIG. 6B illustrates a V-I characteristic in a case where the charge bias is applied.

FIG. 6B illustrates V-I characteristics in cases where the charge bias is applied in the respective circumstances. In FIG. 6B, Line3, Line5, and Line7 exhibit V-I characteristics before discharge starts in the respective circumstances. In FIG. 6B, Line4, Line6, and Line8 exhibit V-I characteristics after discharge starts in the respective circumstances. That is, a Δ value is calculated by subtracting Line3 from Line4. When the Δ value becomes a desired current value Δ1, a voltage at which discharge starts in the L/L circumstance is determined. A Δ value is calculated by subtracting Line5 from Line6. When the Δ value becomes a desired current value Δ2, a voltage at which discharge starts in the N/N circumstance is determined. A Δ value is calculated by subtracting Line7 from Line8. When the Δ value becomes a desired current value Δ3, a voltage at which discharge starts in the H/H circumstance is determined. A gradient of a line (after start of discharge) extending from a branch point joining a line (before start of discharge) with the line (after start of discharge) is changed depending on each circumstance. Therefore, the values Δ1, Δ2, and Δ3 calculated in the respective circumstances are different from one another.

Figure 7:
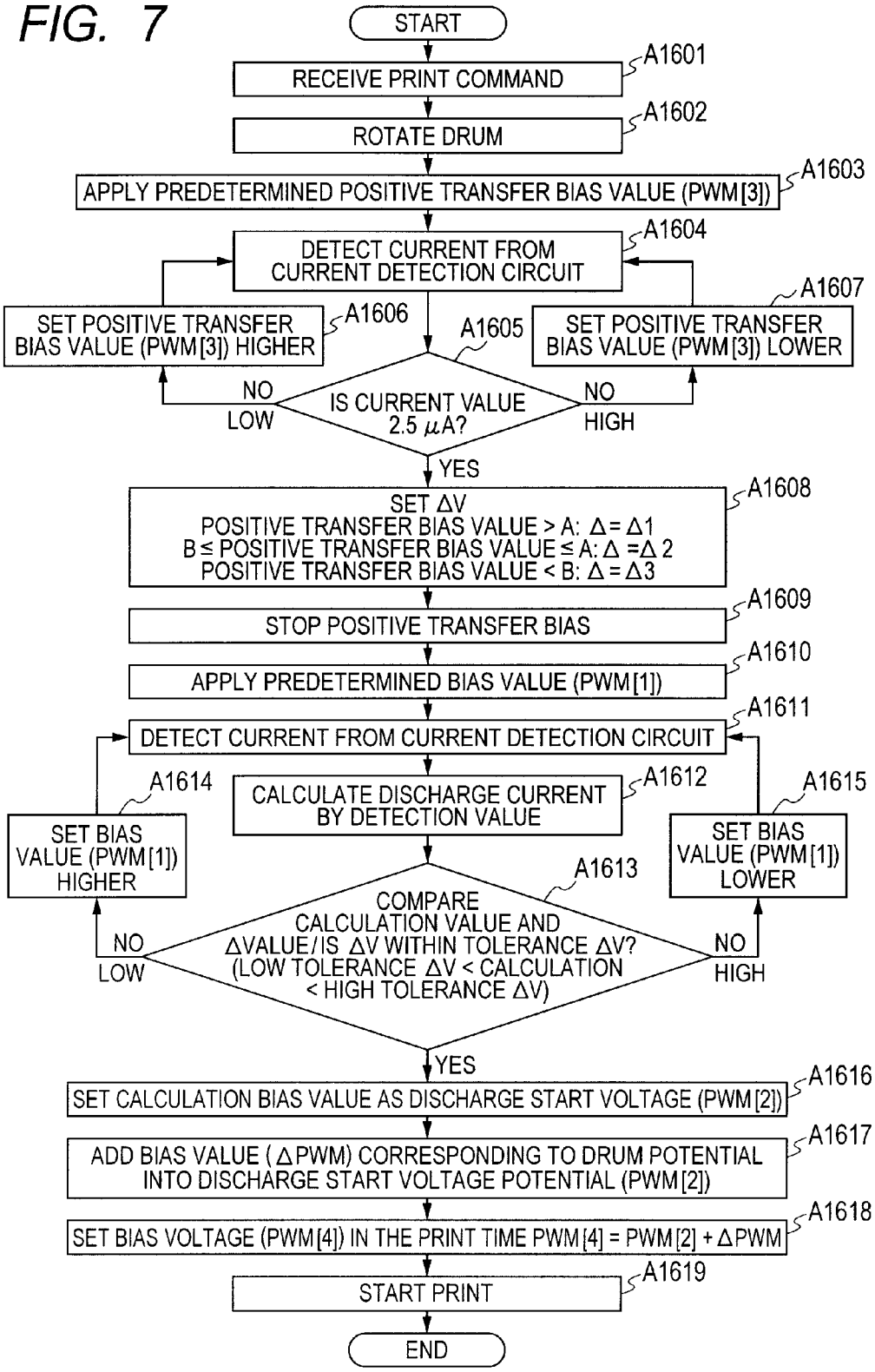
FIG. 7 is a flow chart illustrating processing for controlling the drum potential to a constant value in the second embodiment.

FIG. 7 is a flow chart illustrating the control in this embodiment. Upon receiving a print command (Step A1601), the engine controller 112 enters a forward rotation operation to start rotating the photosensitive drum 101 and the charge roller 102 (Step A1602). The positive-transfer transformer drive circuit part 208 applies the positive transfer bias corresponding to the PWM[3] signal to the transfer roller 108 (Step A1603). The transfer current detection circuit part 214 detects the current I205 flowing through the transfer roller 108 and transmits an analog value of the current from the terminal J201 to the CPU 113. Therefore, the CPU 113 detects the current I205 (Step A1604). The CPU 113 calculates a current value based on the value detected by the transfer current detection circuit part 214 and determines whether or not the calculated current value is equal to 2.5 μA (Step A1605). When the CPU 113 determines that the calculated current value is larger than 2.5 μA, the PWM value (PWM[3]), which is the set value of the positive transfer bias, is set to a low value (Step A1607) and processing returns to Step A1604. When the CPU 113 determines that the calculated current value is smaller than 2.5 μA, the PWM value (PWM[3]), which is the set value of the positive transfer bias, is set to a high value (Step A1606) and processing returns to Step A1604.

When the CPU 113 determines in Step A1605 that the calculated current value is equal to 2.5 μA, processing goes to Step A1608. In Step A1608, the CPU 113 compares the set value of the positive transfer bias with the threshold values "A" and "B" illustrated in FIG. 6A to set the Δ value corresponding to each circumstance. That is, when the CPU 113 determines that the set value of the positive transfer bias is larger than the threshold value "A" (L/L of FIG. 6A), it is determined that Δ=Δ1. When the set value of the positive transfer bias is equal to or smaller than the threshold value "A" and equal to or larger than the threshold value "B" (N/N of FIG. 6A), it is determined that Δ=Δ2. When the CPU 113 determines that the set value of the positive transfer bias is smaller than the threshold value "B" (H/H of FIG. 6A), it is determined that Δ=Δ3. The positive-transfer transformer drive circuit part 208 stops the application of the positive transfer bias (Step A1609).

The common transformer drive circuit part 209 applies, to the charge roller 102, the predetermined charge bias set based on the PWM[1] signal (Step A1610). Processing of Step A1611 to Step A1617 is the same as processing of Step A504 to Step A510 illustrated in FIG. 5 in the first embodiment and thus the description thereof is omitted. Note that, the Δ value used in Step A1613 is any one of the values Δ1, Δ2, and Δ3 set corresponding to the respective circumstances in Step A1608. The CPU 113 determines a bias value for printing (PWM[4] =PWM[2]+ΔPWM) (Step A1618). After the completion of the setting described above, printing starts (Step A1619).

According to this embodiment, a variation in drum potential due to a variation in resistance value of the transfer roller may be prevented and the variation in drum potential may be suppressed using a low-cost structure without providing a detection part including a density detection sensor or a temperature-humidity sensor.

Next, the third embodiment is described. In the third embodiment, the PWM value added to the discharge start voltage is adjusted based on the resistance value of the transfer roller. In this embodiment, the parts corresponding to the same constituent elements as in the second embodiment are denoted by the same reference symbols in the drawings and the description thereof is omitted.

Figure 8:
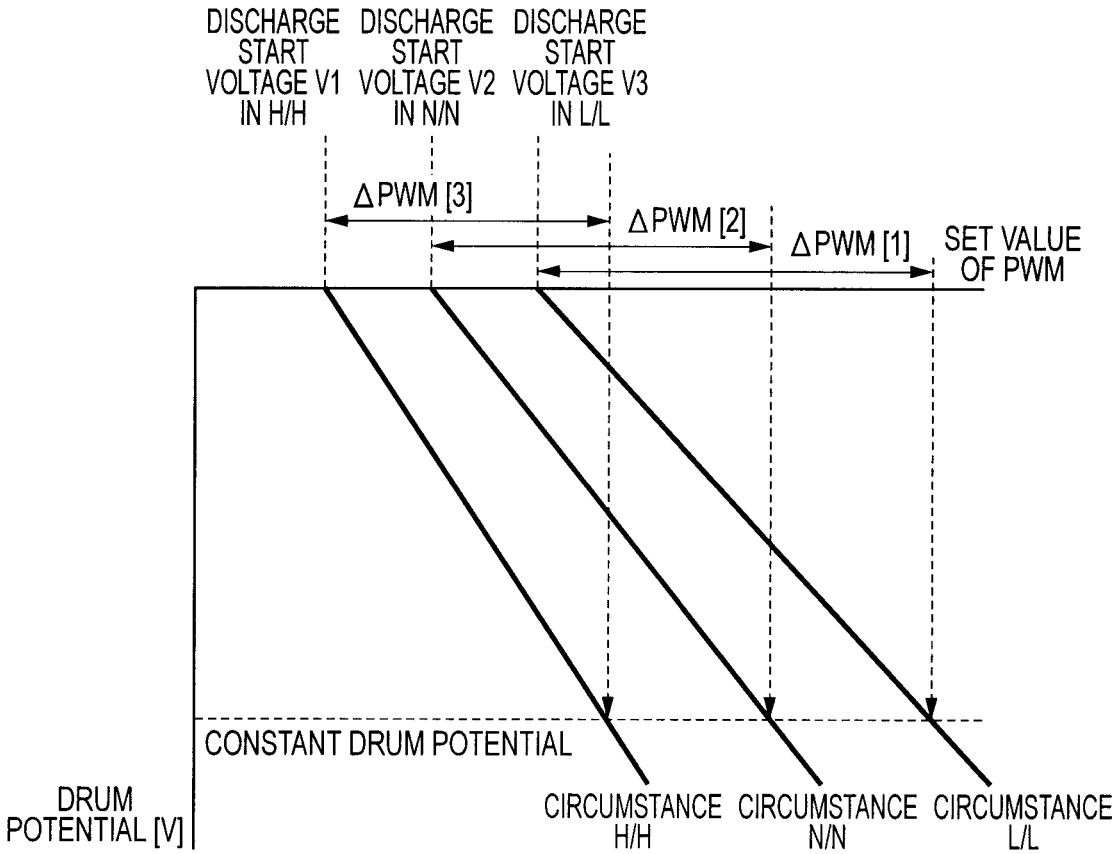
FIG. 8 illustrates correction of the drum potential after the discharge start voltage is detected in a third embodiment.

FIG. 8 is a schematic diagram illustrating correction of the drum potential after the discharge start voltage is detected in this embodiment. FIG. 8 illustrates ΔPWM[3], ΔPWM[2], and ΔPWM[1] which are PWM values added to the charge discharge voltages V1, V2, and V3, respectively, in the respective circumstances. A relationship among the ΔPWM values to be added satisfies "ΔPWM[1]>ΔPWM[2]>ΔPWM[3]".

Figure 9:
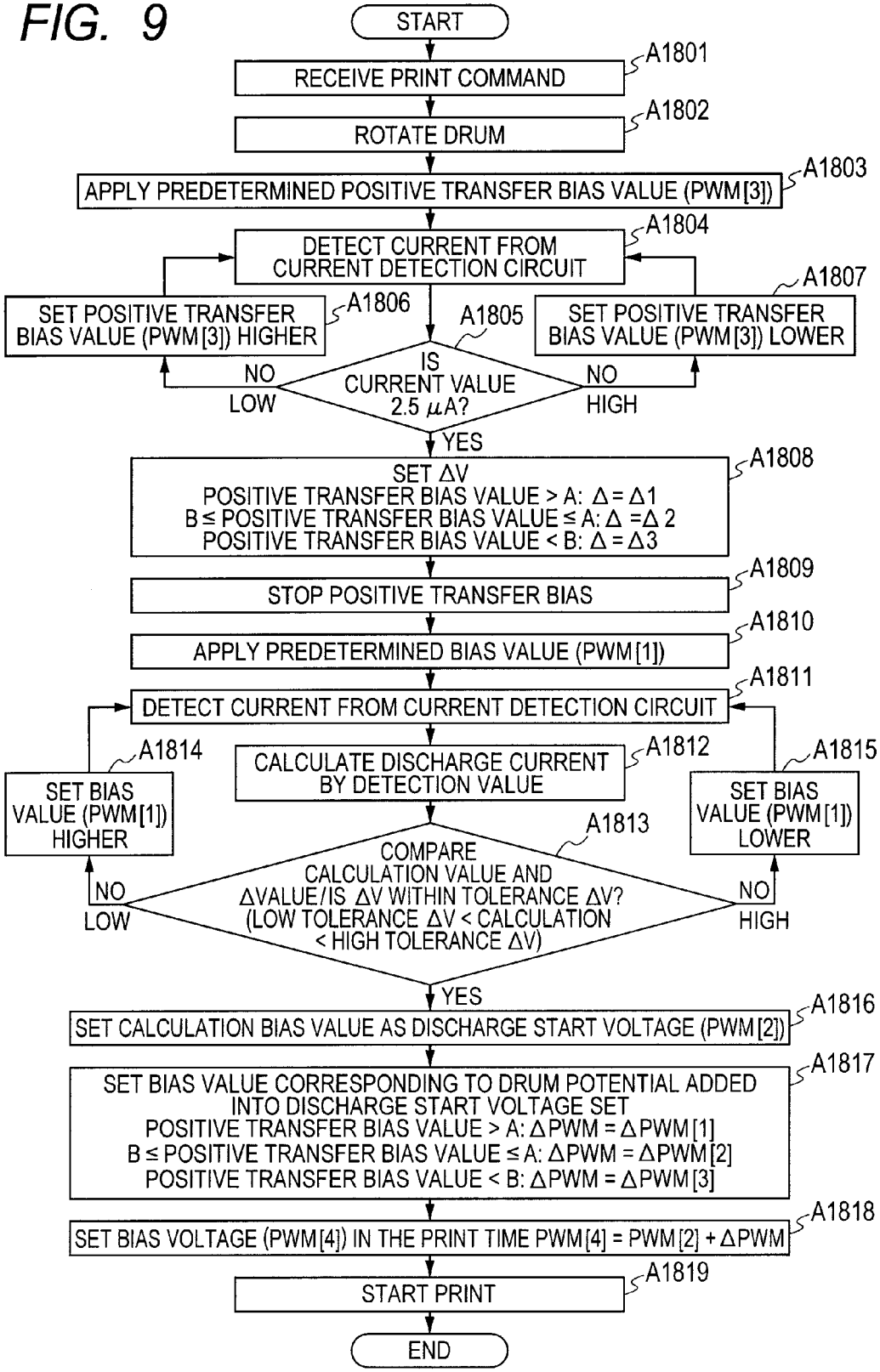
FIG. 9 is a flow chart illustrating processing for controlling the drum potential to a constant value in the third embodiment.
Figure 10A:
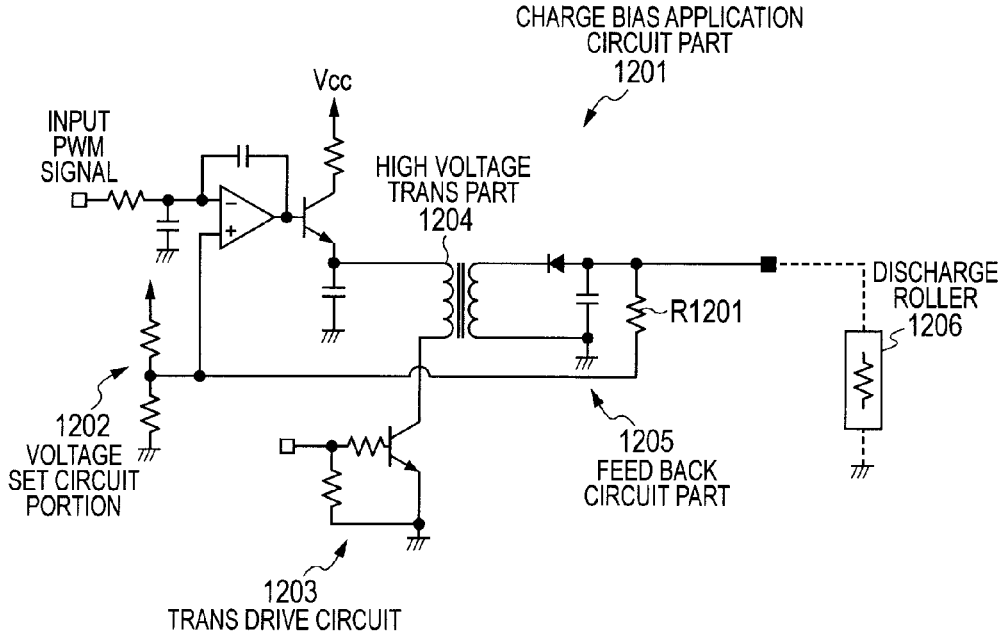
(PRIOR ART) FIG. 10A
FIG. 10A illustrates a charge bias generation circuit according to a conventional example.
Figure 10B:
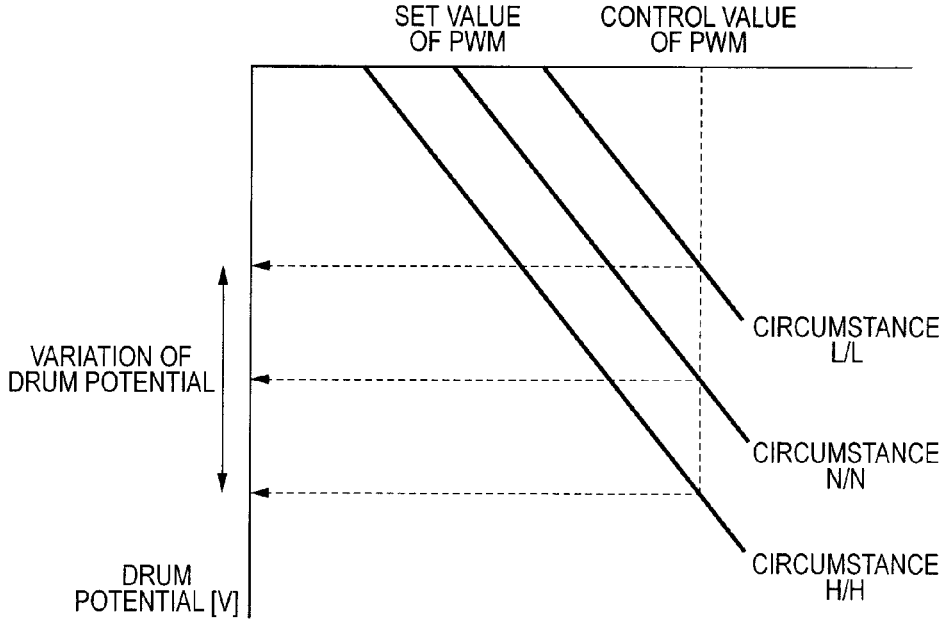
FIG. 10B illustrates a variation in drum potential.

FIG. 9 is a flow chart illustrating the control in this embodiment. Processing of Step A1801 to Step A1816 is the same as processing of Step A1601 to Step A1616 illustrated in FIG. 7 in the second embodiment and thus the description thereof is omitted. The CPU 113 determines the bias value (ΔPWM) corresponding to the drum potential which is added to the discharge start voltage (PWM[2]), based on the set value of the positive transfer bias which is obtained in Step A1808 in the case where the constant current control is performed so that the current value flowing into the transfer roller 108 is 2.5 μA. When the set value of the positive transfer bias is larger than the threshold value "A", the CPU 113 sets "ΔPWM=ΔPWM[1]". When the set value of the positive transfer bias is equal to or smaller than the threshold value "A" and equal to or larger than the threshold value "B", the CPU 113 sets "ΔPWM=ΔPWM[2]". When the set value of the positive transfer bias is smaller than the threshold value "B", the CPU 113 sets "ΔPWM=ΔPWM[3]" (Step A1817). The CPU 113 determines the bias value for printing (PWM [4]=PWM[2]+ΔPWM) (Step A1818). After the completion of the setting described above, printing starts (Step A1819).

According to this embodiment, a variation in drum potential due to a variation in resistance value of the transfer roller may be prevented and the variation in drum potential may be suppressed using a low-cost structure without providing a detection part including a density detection sensor or a temperature-humidity sensor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-255098, filed Nov. 6, 2009 which is hereby incorporated by reference herein in its entirety.

What is claimed is:

1. An image forming apparatus, comprising:

a charging unit that charges an image bearing member on which a latent image is formed;

a latent image forming unit that forms the latent image on the image bearing member charged by the charging unit;

a developing unit that develops the latent image formed on the image bearing member to obtain a developer image;

a transfer unit that transfers the developer image to a recording medium;

a first supply unit that supplies a voltage to the charging unit and the transfer unit, with the first supply unit including a transformer;

a second supply unit that supplies a voltage to the transfer unit, with the second supply unit including a transformer and supplying a voltage opposite in polarity to the voltage supplied from the first supply unit;

a detection unit that detects a current flowing through the transfer unit; and a control unit configured to control power supply, wherein when a power is supplied from the first supply unit to the charging unit, the control unit sets a discharge start voltage in which discharging starts between the image bearing member and the charging unit is based on a current detected by the detection unit, when power is supplied from the second supply unit to the transfer unit, the control unit sets one or more adjusted voltages by calculating one or more voltages to be supplied from the transfer unit so that a current detected by the detection unit is to be a predetermined value, and the first supply unit supplies a voltage to the charging unit based on the discharge start voltage and the adjusted voltage set by the control unit.

2. An image forming apparatus according to claim 1, wherein the first supply unit supplies a voltage in which one or more correction values according to one or more of the adjusted voltages are added into the discharge start voltage.

3. An image forming apparatus according to claim 2, wherein the one or more correction values are determined according to a temperature or a humidity.

4. An image forming apparatus according to claim 2, wherein one or more correction values include a first correction value, a second correction value larger than the first correction value, and a third correction value larger than the second correction value, wherein the control unit compares the adjusted voltage with a first threshold value and a second threshold value less than the first threshold value, and when the adjusted voltage is larger than the first threshold value, the control unit chooses the first correction value, when the adjusted voltage is equal to or less than the first threshold value and larger than the second threshold value, the control unit chooses the second correction value, and when the adjusted voltage is equal to or less than the second threshold value, the control unit chooses the third correction value.

5. A power supply apparatus for an image forming apparatus, the image forming apparatus having an image bearing member, a charging unit that charges the image bearing member and a transfer unit that transfers an image formed on the image bearing member, comprising:

a first supply unit that supplies a voltage to the charging unit and the transfer unit, the first supply unit including a transformer;

a second supply unit that supplies a voltage to the transfer unit, the second supply unit including a transformer and a supplying voltage supplied from the second supply unit opposite in polarity to the voltage supplied from the first supply unit;

a detection unit that detects a current flowing through the transfer unit; and a control unit configured to control power supply, wherein when power is supplied from the first supply unit to the charging unit, the control unit sets a discharge start voltage in which discharging starts between the image bearing member and the charging unit is based on a current detected by the detection unit, when power is supplied from the second supply unit to the transfer unit, the control unit sets one or more adjusted voltages by calculating one or more voltages to be supplied from the transfer unit so that a current detected by the detection unit is to be a predetermined value, and the first supply unit supplies a voltage to the charging unit based on the discharge start voltage and the adjusted voltage set by the control unit.

* * * * *